US005839494A

United States Patent [19]

Judkins

[11] Patent Number: 5,839,494

[45] Date of Patent: Nov. 24, 1998

[54] BOTTOM AND TOP STACKING VENETIAN TYPE BLIND WITH FIXED HEADRAIL TILT

[76] Inventor: Ren Judkins, 46 Newgate Rd., Pittsburgh, Pa. 15202

[21] Appl. No.: 998,509

[22] Filed: Dec. 27, 1997

Related U.S. Application Data

[63] Continuation-in-part of Ser. No. 972,852, Nov. 18, 1997, which is a continuation of Ser. No. 661,192, Jun. 10, 1996, Pat. No. 5,692,552, which is a continuation of Ser. No. 384,136, Feb. 6, 1995, Pat. No. 5,573,051.

[51] Int. Cl.[6] ..... E06B 9/30

[52] U.S. Cl. ..... 160/167 R; 160/171 R

[58] Field of Search ..... 160/168.1 R, 167 R, 160/170 R, 171 R, 172 R, 173 R, 176.1 R, 177 R, 178.1 R

[56] References Cited

U.S. PATENT DOCUMENTS

| | | | |
|---|---|---|---|
| 7,408 | 6/1850 | Bohrer . | |
| 12,685 | 4/1855 | Rose . | |
| 262,399 | 8/1882 | Gibson et al. . | |
| 2,140,049 | 12/1938 | Grauel | 156/10 |
| 2,162,226 | 6/1939 | McKinney | 156/17 |
| 2,200,349 | 5/1940 | Walker | 156/17 |
| 2,231,778 | 2/1941 | Swanson | 156/17 |
| 2,283,640 | 5/1942 | Kwon | 156/17 |
| 2,307,278 | 1/1943 | Krantz | 160/173 |
| 2,374,591 | 4/1945 | Dunn | 160/177 |
| 2,381,060 | 8/1945 | Kahn | 160/170 |
| 2,397,765 | 4/1946 | Sylvanus | 160/168 |
| 2,401,283 | 5/1946 | Williams | 160/173 |
| 2,407,554 | 9/1946 | Isserstedt | 160/173 |
| 2,572,224 | 10/1951 | Walker | 160/173 |
| 2,573,700 | 11/1951 | Ferguson et al. | 160/173 |
| 2,576,159 | 11/1951 | Walker | 160/178 |
| 2,583,031 | 1/1952 | Walker | 160/168 |
| 2,587,756 | 3/1952 | Palmisano | 160/168.1 |
| 2,591,570 | 5/1952 | Walker | 160/178 |
| 2,632,506 | 3/1953 | Walker | 160/178 |
| 2,687,770 | 8/1954 | Walker | 160/176 |
| 2,690,215 | 9/1954 | Croxen | 160/173 |
| 2,783,831 | 3/1957 | Moyer | 160/173 |
| 3,294,153 | 12/1966 | Fountain | 160/163 |
| 3,460,601 | 8/1969 | Abraham | 160/168 |
| 4,168,735 | 9/1979 | Frei | 160/168 |
| 4,200,135 | 4/1980 | Hennequin | 160/168 |
| 4,621,673 | 11/1986 | Georgopoulos et al. | 160/168 |
| 4,651,794 | 3/1987 | Bytheway, Jr. | 160/168 |
| 4,697,630 | 10/1987 | Rude | 160/166 |
| 4,708,188 | 11/1987 | Bytheway, Jr. | 160/174 |
| 4,723,586 | 2/1988 | Spangenberg | 160/107 |
| 4,869,308 | 9/1989 | Chang | 160/176.1 |
| 4,917,168 | 4/1990 | Chen | 160/177 |
| 4,940,070 | 7/1990 | Warden | 160/176.1 |

(List continued on next page.)

FOREIGN PATENT DOCUMENTS

| | | |
|---|---|---|
| 1467038 | 10/1968 | France . |
| 630127 | 11/1949 | United Kingdom . |

*Primary Examiner*—David M. Purol
*Attorney, Agent, or Firm*—Buchanan Ingersoll, P.C.

[57] ABSTRACT

A bottom stacking and top stacking venetian type blind has a fixed headrail containing a tilt mechanism which tilts the lift cords as well as the movingrail and bottomrail, maintains the centerline plane and center of gravity in the same place throughout the operation of the blind, and provides cord locks for the two sets of lift cords. This blind consists of the fixed headrail containing both tilting and lifting mechanisms; a one-piece or two-piece movingrail; a one-piece or two-piece bottomrail; and a plurality of slats which rest on ladders between the bottomrail and movingrail. The ladders are typically made of cord, but the hardware of this blind will also accommodate fabric tape or sheet ladders. There will always be at least one pair of lift cords which control the movingrail; one cord in the front, and one in the rear. The bottomrail will also have two lift cords passing through, one on each side, if it is a single rail; or four cords for a double rail. A preferred embodiment contains an axle driven cord collecion system.

21 Claims, 12 Drawing Sheets

U.S. PATENT DOCUMENTS

| | | | |
|---|---|---|---|
| 4,951,729 | 8/1990 | Chi Yu | 160/178.3 |
| 5,060,709 | 10/1991 | Simon | 160/168.1 |
| 5,123,472 | 6/1992 | Nagashima et al. | 160/170 |
| 5,139,072 | 8/1992 | Marocco | 160/176.1 |
| 5,207,261 | 5/1993 | Quezel Castraz | 160/176.1 |
| 5,228,491 | 7/1993 | Rude et al. | 160/176.1 |
| 5,232,037 | 8/1993 | Fraser | 160/168.1 |
| 5,285,838 | 2/1994 | Rapp et al. | 160/168.1 |
| 5,309,974 | 5/1994 | Fraser | 160/176.1 |
| 5,341,865 | 8/1994 | Fraser et al. | 160/176.1 |
| 5,443,108 | 8/1995 | LeVert et al. | 160/167 |

IV
IV
III
III
3
4
2
7
6
46
52
2
3
9
4
51
V
V
10
58
7
15
6
34
36
21, 22, 23 & 24
38
47
44

111
52
113
111
111
113
112
112
51
113
112
6
6

BOTTOM AND TOP STACKING VENETIAN TYPE BLIND WITH FIXED HEADRAIL TILT

CROSS REFERENCE TO RELATED APPLICATION

This is a continuation in part of U.S. Pat. application Ser. No. 08/972,852 filed Nov. 18, 1997, which is a continuation of U.S. Pat. application Ser. No. 08/661,192 filed Jun. 10, 1996, and issued Dec. 2, 1997, as U.S. Pat. No. 5,692,552, which is a continuation of U.S. Pat. application Ser. No. 08/384,136 filed Feb. 6, 1995, and issued Nov. 12, 1996 as U.S. Pat. No. 5,573,501.

FIELD OF INVENTION

This invention relates to venetian type blinds which can be stacked and deployed from the top down as are common, or stacked and deployed from the bottom up.

BACKGROUND OF THE INVENTION

Venetian blinds consist of a plurality of horizontal slats. These slats rest on ladders made of cord, fabric tape, or flexible sheets of sheer material. Blinds have a headrail and bottomrail, the bottomrail being either one solid rail or two parallel rails connected by a cord. The blinds have a lift cord or cords, traditionally connected from the bottomrail through route holes in the slats, to a lift mechanism or cord lock in the headrail. Another arrangement is provided in my U.S. Pat. No. 5,763,051, in which lift cords are placed proximate to the front and rear edges of the slats, and tiny notches or slots are made in the slats for the lift cords to pass through from the bottomrail into the headrail. Blinds are raised to stack slats at the top by pulling the lift cords through a cord lock, which locks into place by pulling the lift cords laterally to catch the lock and then back to set the lock. Alternately, an axle driven cord collection system may be used for one or more sets of lift cords in place of a cord lock.

In U.S. Pat. No. 7408, Bohrer describes a venetian blind in which all slats can be stacked at the bottomrail by means of a pulley assembly. He introduced a movingrail which houses a tilt mechanism and to which the ladders are connected to hold the slats. The operator lifts the movingrail by pulling a lift cord through a pulley assembly, then hooking the cord onto cleats. This design tilts the slats by pulling a tilt cord connected to a tilt mechanism in the movingrail which twists the movingrail and is difficult to operate. The lift cords must be pulled and cleated at an angle to the wall, creating a less streamlined, less neat appearance.

A similar blind is described by Rose in U.S. Pat. No. 12,695. Rose uses a fixed headrail and a movingrail and provides a complex series of hooks and cords to lock the movingrail into place at the headrail. This facilitates the tilting of the slats relative to the movingrail by holding it steady. The mechanism, however, is complicated and uses several pieces of additional hardware not necessary in traditional venetian type blinds. It also requires the blind to be lifted to the headrail to be tilted.

In U.S. Pat. No. 2,223,640, Kwon describes a blind which also uses a movingrail, but with a different lifting and tilting mechanism. The blind is raised from a bottom-stacked position by pulling and cleating two sets of tilt/lift cords simultaneously; the blind is tilted by pulling one set of the cords more than the other. This arrangement requires two-hand operation of the blind, which is difficult in many room settings. It also involves shifting the center of gravity of the blind away from or toward the window, causing a gap between the tilted blind and the window in the first case and causing the stack to drag on the wall or the window in the second case.

Most recently, Levert et al. describe an upwardly deployed blind in U.S. Pat. No. 5,443,108. This design consists of a fixed headrail, a movingrail, and a bottom rail. The tilt assembly is again placed on the movingrail. The blind is raised from a bottom-stacked position by pulling a drawstring in the headrail connected to a cord lock. To tilt the blind, a tilt bar on the movingrail is used. This reduces the twist of the movingrail somewhat, but is very bulky and is potentially awkward to operate because the movingrail is constantly changing position relative to the operator.

These previous inventions are all attempts to fill a need for bottom-and-top stacking venetian type blinds, which will allow the operator ease in cleaning and more choices as to how to stack the blind for the desired combination of light passage and privacy. There is a need for a venetian blind which can accomplish stacking the slats at the headrail or the bottomrail without the unsightly addition of wall-mounted cleats and cords hanging at an angle; without additional, complex hardware; and without a shift in the center of gravity which causes the blind to hang at an awkward angle to the window. In addition, there is a need to create a bottom-and-top stacking venetian blind with simple one-hand operation of the lifting and tilting mechanism and with optimum position and leverage of both lifting and tilting mechanisms for the convenience of the user. Ideally, this blind will also require a minimum of additional hardware that will serve for the design options using slats with route holes and a centerline lift cord, a lift cord system with hidden holes in the rear of the slats, or slats with no holes and an edge lift system. Also the blind should be able to utilize cord ladders, fabric tape ladders, or sheer material sheet ladders. Overall, there is still a need for an easily operated, neat-looking, bottom-and-top stacking venetian type blind with several style options.

SUMMARY OF THE INVENTION

I provide a venetian type blind with a fixed headrail containing a tilt mechanism. This tilt mechanism tilts the lift cords which support the movingrail. In turn, the blind is tilted via the ladders which run from the movingrail to the bottomrail. This tilt mechanism maintains the centerline plane and center of gravity in the same place throughout the operation of the blind. I provide for either cord locks for the two sets of lift cords of the blind, or for a cord lock and an axle driven cord collection system. This blind consists of the fixed headrail with both tilting and lifting mechanisms; a one-piece or two-piece movingrail; a one-piece or two-piece bottomrail; and a plurality of slats which rest on ladders between the bottomrail and movingrail. The ladders are typically made of cord, but the hardware of this blind will also accommodate fabric tape or sheet ladders. There will always be at least one pair of lift cords which control the movingrail; one cord in the front, and one in the rear. Two pairs of lift cords will be used if the movingrail is a double rail. The bottomrail will also have at least two lift cords passing through, one on each side, if it is a single rail; or four cords for a double rail. The single pair of lift cords may pass through route holes in the center or on the back edges of the slats to the bottomrail. Alternately, four lift cords could be used, one pair on each side passing through notched slats to the bottomrail in an edge lift system. The blind is lifted from a bottom-stacked position by raising the movingrail using the lift cords which are attached to the movingrail. The blind may be partially raised and partially or fully stacked at any point between the headrail and bottomrail by locking the movingrail into the desired position and adjusting the bottomrail if desired. The blind may also be stacked at the top and deployed downward by first raising the movingrail, then using the bottomrail lift cords to raise the bottomrail, stacking the slats between the bottomrail and movingrail. The blind can even be deployed downward from this position by using the movingrail cords.

A preferred tilt mechanism in the fixed headrail uses a disk or bar through which a set of lift cords is connected to the movingrail. To tilt the blind, the disk or bar is rotated, and the lift cords are moved together by raising either the front lift cord or the rear lift cord while lowering the other. The movingrail tilts as the lift cords are moved; if a double rail is used, one side is raised as the other is lowered just as with the lift cords. The slats then tilt to the front or rear accordingly. A variation of this tilt mechanism is shown which can be used in blinds which require a very short headrail. This variation provides cord locks which shift laterally in equal but opposite directions, tiling the lift cords. The movingrail will tilt, and the entirety of the blind tilts accordingly.

There are several distinct advantages of my new venetian type blind which set it apart from those attempted earlier. The tilt mechanism shifts the weight of the blind while maintaining the center of gravity rather than lifting the weight, which would cause a shift in the center of gravity. The distance of the blind from the window is therefore the same when tilted in either direction. The tilt and lift controls may operate independent of one another, are both in a fixed position at the headrail which is the optimum position relative to the operator, and can both be operated with simple one-hand controls. The tilt and lift systems of the movingrail can also be controlled simultaneously on a monocontrol axle driven cord collection system if desired. Furthermore, by containing all the lifting and tilting hardware in one fixed headrail, the same hardware can be used "as is" in the traditional and new types of blinds, such as the centerline lift cord system, the hidden holes lift system, the edge lift system, a fabric tape ladder design, and a fabric sheet ladder design. A manufacturer will not need to produce or purchase a new and expensive hardware system to make any of these types of blinds or any combination of these blind elements.

DETAILED DESCRIPTION OF THE PREFERRED EMBODIMENTS

Figures 1, 2:
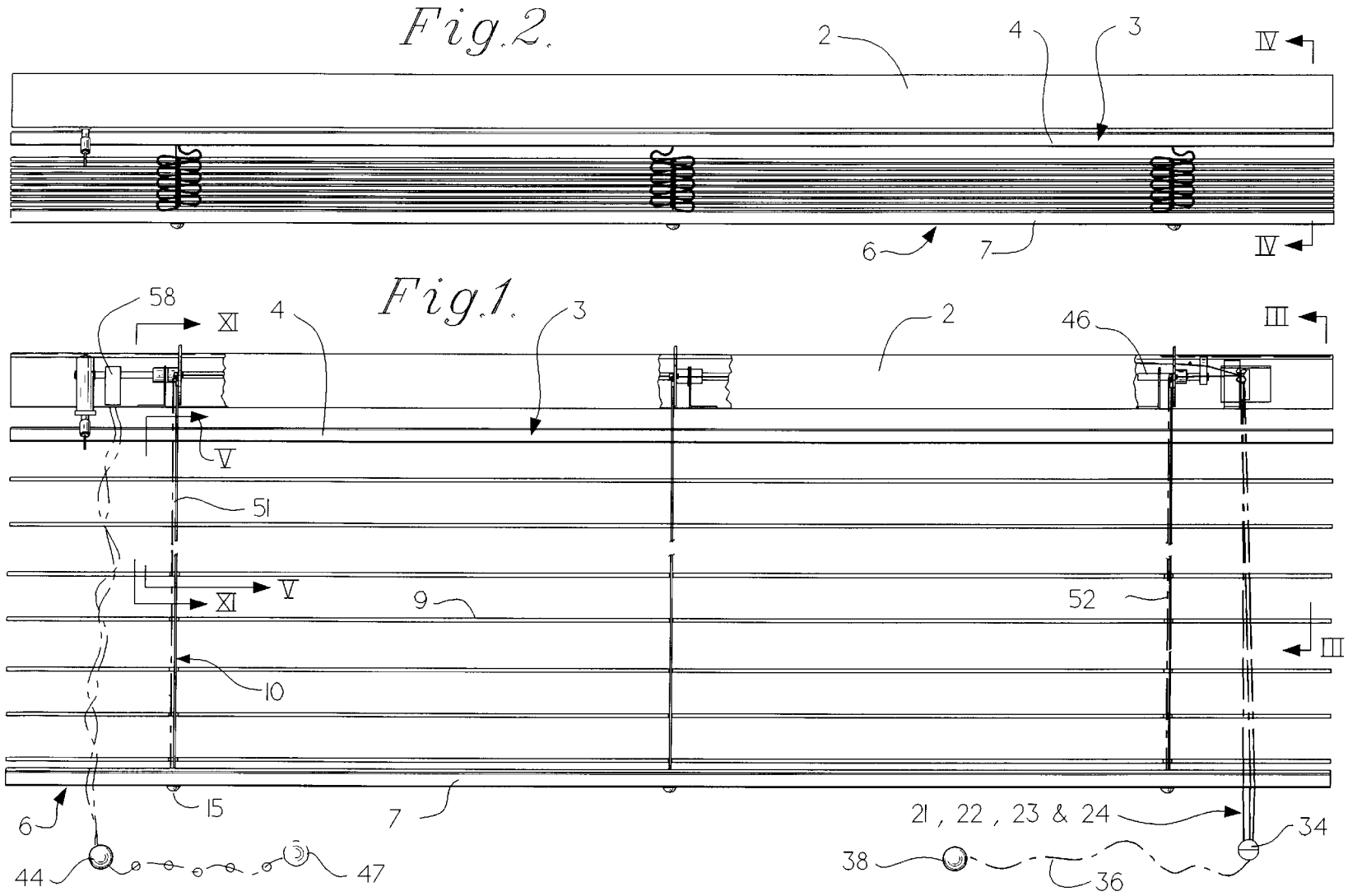
FIG. 1 is a front view of the present preferred embodiment of my venetian type blind shown in an unstacked position.
FIG. 2 is a front view similar to FIG. 1 showing the blind when it is in a raised and top-stacked position.
Figure 3:
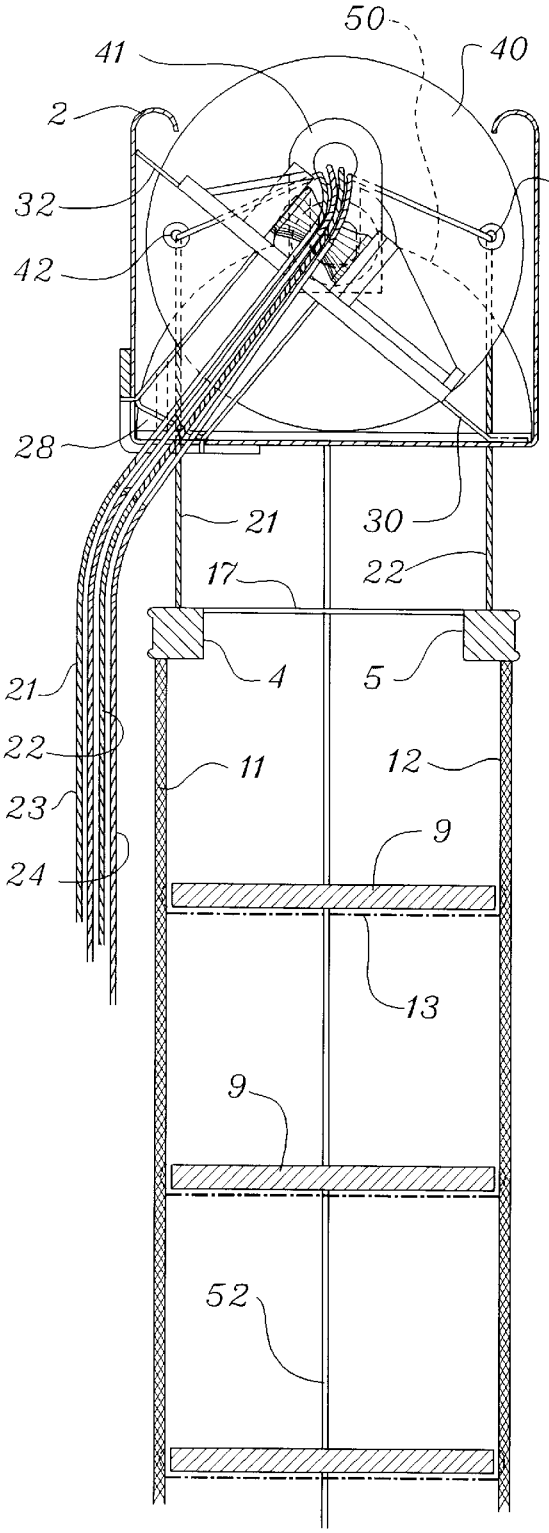
FIG. 3 is a sectional view taken along the line III—III of FIG. 1.
Figure 4:
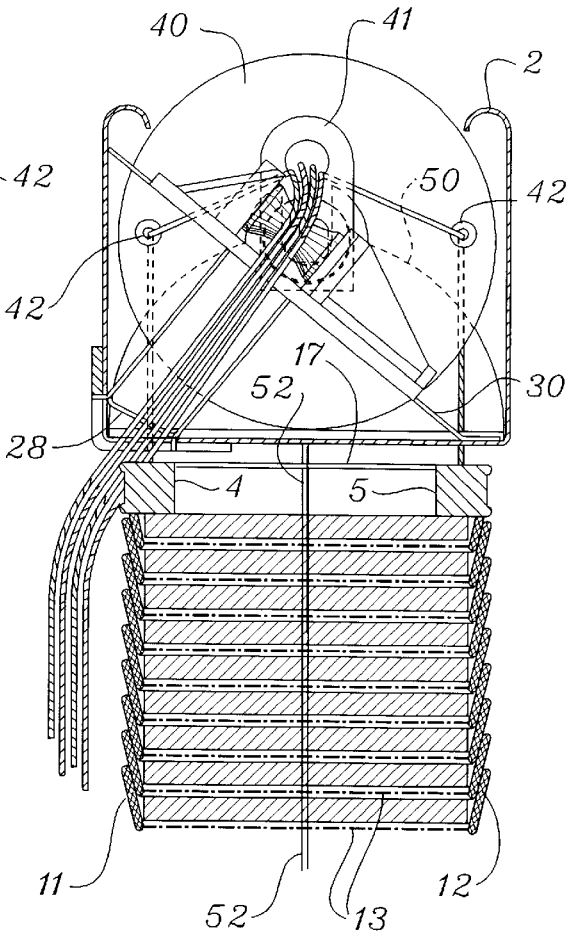
FIG. 4 is a sectional view similar to FIG. 3 taken along the line IV—IV of FIG. 2.
Figure 5:
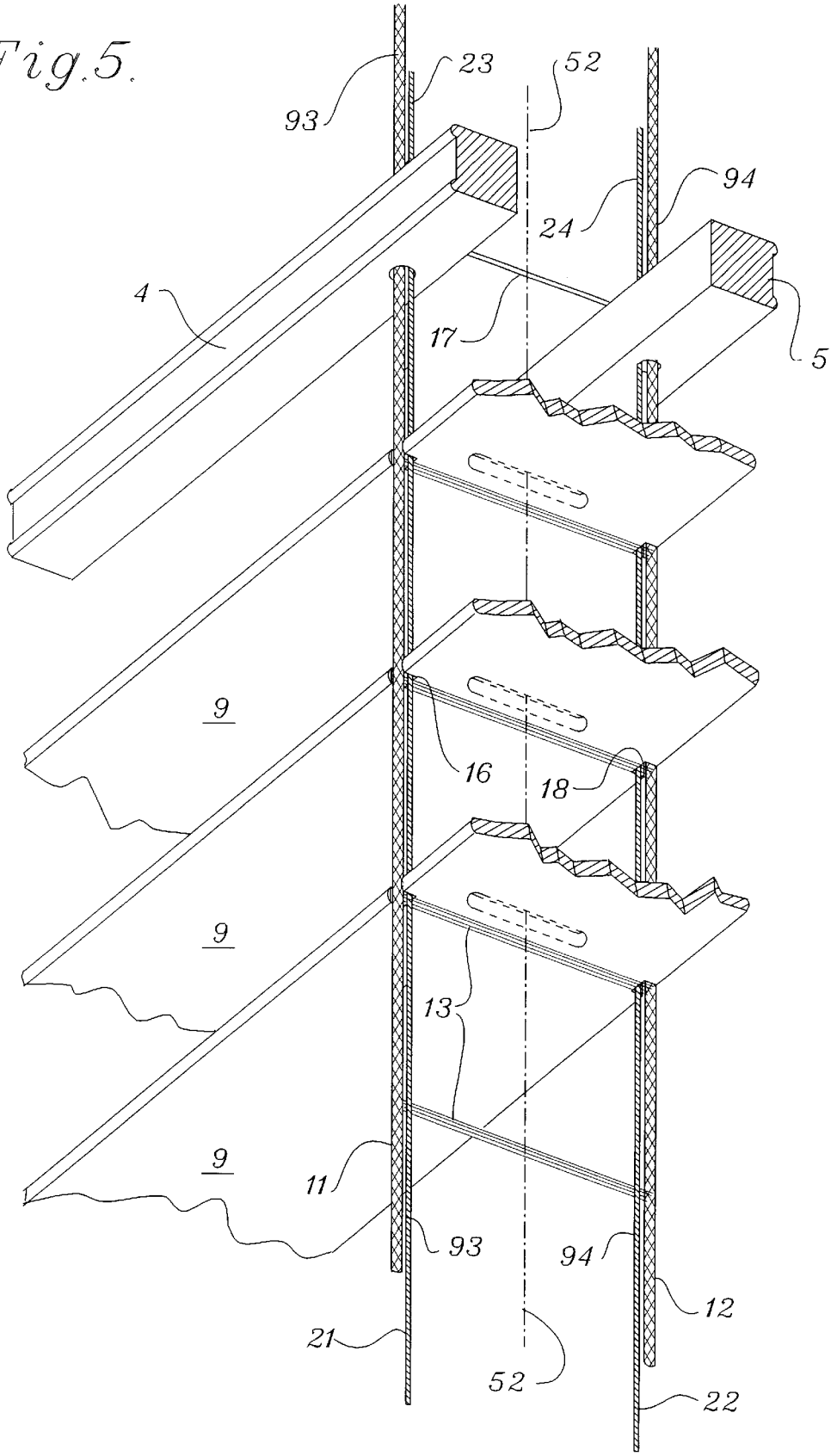
FIG. 5 is a perspective view of a portion of the embodiment shown in FIG. 1 taken around the line V—V if FIG. 1.

The first preferred embodiment, as best shown in FIGS. 1–4, 11, and 12, has a fixed headrail 2 housing tilt mechanism, a movingrail 3 having a front rail 4 and a rear rail 5 which can be seen most clearly in FIGS. 3 and 4, and a bottomrail 6 having front 7 and rear 8 rails. A set of slats 9 are positioned between the bottomrail and the movingrail on a set of cord ladders 10 which support the slats. The cord ladders 10 consist of front rails 11, rear rails 12, and rungs 13 on which the slats rest. A first set of at least one but preferably two pairs of lift cords 21–24 extend from the movingrail through the headrail. A second set of two or more lift cords 51, 52 extend from the bottomrail through the headrail. These elements will be discussed further herein.

The movable body of the blind consists of the movingrail 3, bottomrail 6, and slats 9 which are positioned therebetween. I prefer to use a two-piece movingrail and bottomrail although both the movingrail and the bottomrail can be one-piece or two-piece. The number of lift cords may vary from two for a single rail to four or more for a double rail. For illustration purposes, the drawings show only six slats. Any number of slats, most likely more than six, will be used. The slats shown are symmetric to a horizontal plane passing through the front and back edges of the slat. Other types of slats, such as crowned, s-shaped, or asymmetrical slats, may be used instead of the flat slats. The slats are suspended on a cord type ladder 10. A third ladder that is not accompanied by lift cords is shown. More ladders and lift cords may be used for wider or heavier blinds. Ladder rungs are preferably groups of two to four cords. As shown in FIGS. 1 and 2, the bottom ends of the ladders are knotted within the bottomrails 7, 8, and are covered by plugs 15. If desired, cord ladders could be replaced with fabric tape ladders or sheets of flexible material. Cord 17 is provided to tie the movingrails and bottomrails 7, 8 together to prevent flaring out.

Figure 11:
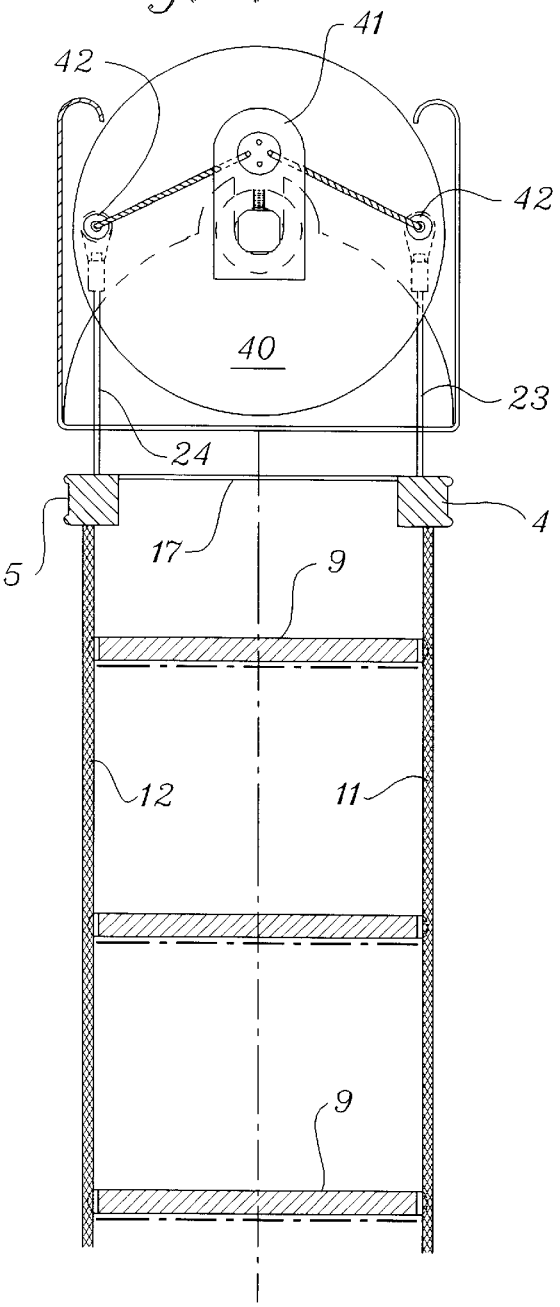
FIG. 11 is a sectional view taken along the line XI—XI of FIG. 1 with the lift cords of the bottomrail shown in chain line for clarity.

One set of four lift cords 21–24 passes from the movingrail 3 through the headrail and into a cord lock. These lift cords support and control the movingrail thereby transferring the tilting motion of the tilt mechanism. As shown in FIGS. 1 and 2, the lift cords 21–24 originate in the movingrail and extend through the headrail. Only one cord is needed on each side of a single movingrail; however, I prefer the two-piece movingrail as shown in FIGS. 3,4, and 11. Lift cords 21 and 23 extend from the front movingrail into the headrail. Cords 22 and 24 extend from rear movingrail through the headrail. Each pair of lift cords 21, 22 and 23, 24 is threaded through the headrail 2 where they are supported by the tilt mechanism.

FIGS. 1–4 and 10–12 show the tilt mechanism. The tilt assembly is supported by cradles 50. The lift cords 21–24 pass through the disk 40 at the disk cord guides 42, then pass through the tilt rod centering cord guide 41. The cords from the left side 23, 24 pass through the center disk, the right disk, the right tilt rod cord guide, and finally extend over a pulley 27 and into a cord lock 28 provided in the headrail. Preferably, the cord lock is always engaging the lift cords unless the blind is being raised or lowered. A support plate 30 is provided to attach the cord lock 28 to the headrail 2. Support 32 holds pulley 27 in place. The lift cords 21–24 pass through this lifting and tilting assembly to a position outside the headrail 2 at one end of the blind, in this case the right side. The distal end of the lift cords may be tied together in a ball connector 34. If desired a pull cord 36 having a tassel 38 may be connected to the ball connector 34.

This design requires a additional set of lift cords 51, 52 to lift and control the bottomrail. I prefer to use one pair of lift cords in a centerline system. However, more may be needed if the bottomrail is composed of two pieces, which is an option of an edge lift system, or if the blind is large or heavy. As shown in FIGS. 1, 3, 4, 5, and 9, two centerline lift cords 51, 52 originate at the bottomrail and are threaded through route holes in each slat 9, over a roller 57 and through a hole in the center of the cradle 50. The cords are routed through the headrail 2 where they pass through a cord lock 128. Preferably, the cord lock is always engaging the lift cords unless the blind is being raised or lowered. The pair of cords extend from the cord lock 128 to a position outside the headrail 2 at the opposite end from the movingrail lift cords 21–24. The distal end of the lift cords 51, 52 may be tied together in a ball connector 44. If desired a pull cord 45 having a tassel 47 may be connected to the ball connector 44.

Figure 15:
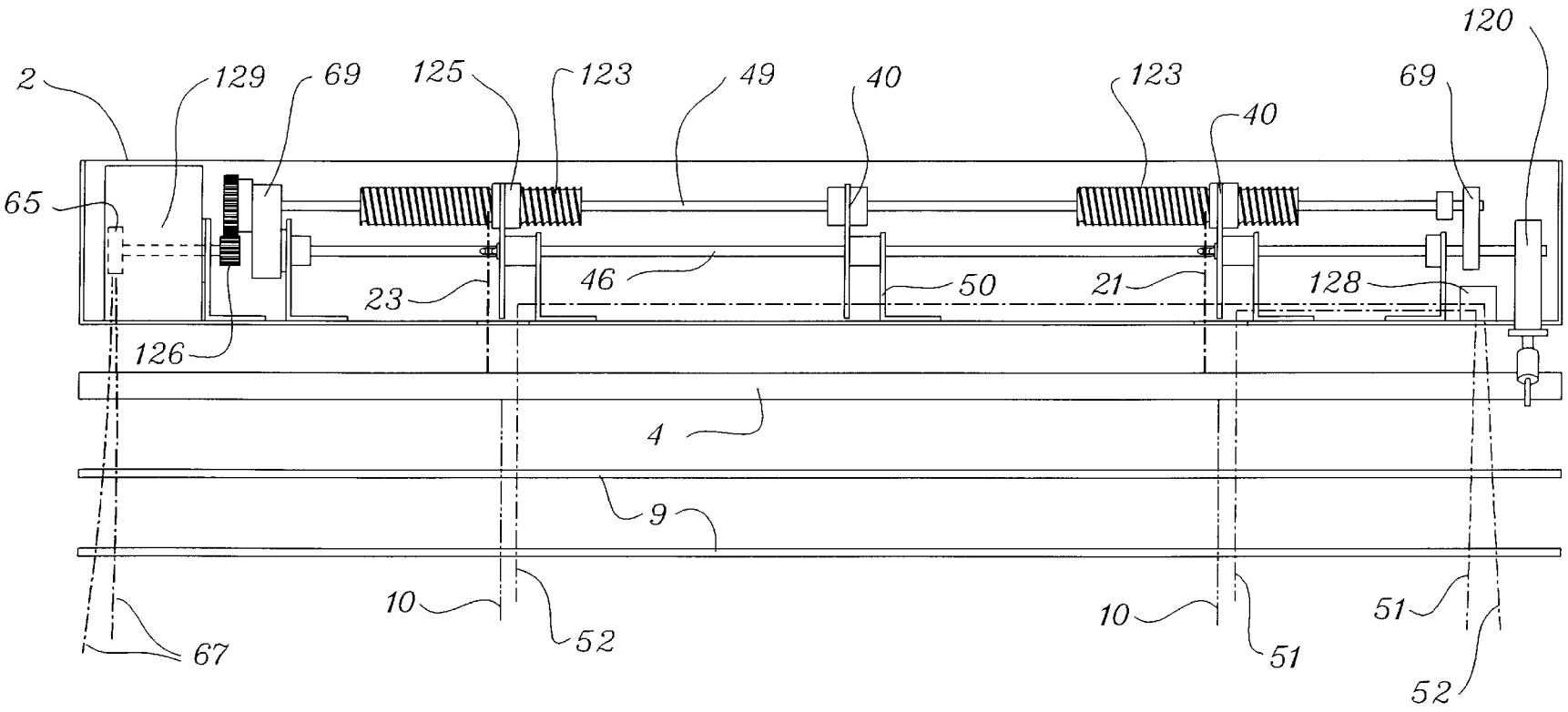
FIG. 15 is a front view of the top portion of the another preferred embodiment with the front panel of the headrail removed which embodiment contains an axle driven cord collection system.

To distinguish the bottomrail cords from the movingrail cords, an axle driven cord collection system may be used for either set of the lift cords while the pulley and cord lock arrangement can be used for the other set. I prefer to use this system for the lift cords of the movingrail due to advantages which are described herein. As shown in FIG. 15, the axle driven cord collection system is comprised primarily of the of the lift axle 49, the spools 123, a gear drive train 126, a clutch or releasable brake 129, a sprocket 65 and control cord or chain 67. The spools are mounted directly around the lift axle and each carry a pair of movingrail lift cords. However, only one lift cord 21, 23 can be seen for each spool in FIG. 15. I prefer that the axle 49 have a non-round cross section and fit through a matching longitudinal bore in the threaded spools 53. The lift axle 49 runs through the tilt disks 40 directly above the tilt rod 46 on the radius that is perpendicular to the diameter that includes the lift cord guide ring 42. The lift axle 49 is aligned and connected to the tilt rod 46 via the disks and the axle coupler 69. For those disks located near pairs of lift cords, a collar 125 having internal threads extends from the disk and encircles the spool 123. The disks and attached collars are restrained from axial movement along the lift axle 49 and tilt rod 46. Tilt mechanism 120 turns axle 46 to turn discs 40 moving axle 49 through an arc normal to the axle. That movement lifts the front movingrail lift cords and lowers the back movingrail lift cords or vice versa to tilt the movingrail 4. Tilting the movingrail 4 causes the ladders 10 to tilt the slats 9. Rotation of axle 49 will cause the threaded spools to rotate and because they are engaged with the threads of the collars 125, the spools will move laterally. When axle 49 is rotated counterclockwise the lift cords will be wound onto the threaded spools 123 and the spools will move from right to left. When the axle 49 is rotated clockwise, the lift cords will be unwound and the threaded spools 123 will move from left to right. The axle 49 is rotated by pulling a cord or chain control 67 which turns the sprocket 65. The sprocket 65 is connected through the clutch or releasable brake 129 to the gear drive train 126 and thus to the axle 49. I prefer that the lift system be configured to provide a 2:1 gear ratio. Motors and other gear arrangements and drives can be used. Each spool collects one pair of lift cords in this embodiment, but could also collect just a single cord. The cords wind around the spool so that the lift cord extending from the front is wound adjacent to the lift cord extending from the rear as shown in FIG. 15. Thus, turning of the drive axle 49 will raise or lower the lift cords in the front and the back at the same time. To lower the blind, the other side of the control cord 67 is pulled to reverse the direction of rotation of axle 49 and unwind the cords from the spools. A tube lift mechanism such as is disclosed in U.S. Pat. No. 5,184,660 can be adapted for this embodiment.

The use of the axle driven cord collection system will provide particular advantages when used as the system for controlling the lift cords of the movingrail. For instance, the axle driven cord collection system provides far greater support for the weight of the blind as compared to pulleys and cord locks. Since the movingrail is generally locked in position at some raised point so that the user may achieve some privacy, there is usually some load being supported by the lift cords of the movingrail. The axle driven cord collection system provides a support system for these lift cords, which helps reduce wear and tear on the cords as they hold the load of the blind. In addition, the mechanical advantage provided by the gear drive train and cord control will help the operator to raise the movingrail and the blind more easily, especially in the case of large or heavy blinds. Finally, the smaller cord or chain control of the axle driven cord collection system will not hang long at the side of the blind when the movingrail is raised to any degree. This helps to create a neater appearance when the movingrail is partially or fully raised.

The number of lift cords used will vary according to the size of the blind and cording arrangement. For instance, an edge lift system may be used to control the bottomrail, which would require at least one cord on the front and one on the back side of the bottomrail, and preferably two pairs of cords. This would allow for the use of slats with notches or grooves along which the lift cords and ends of ladder rungs pass.

Figure 12:
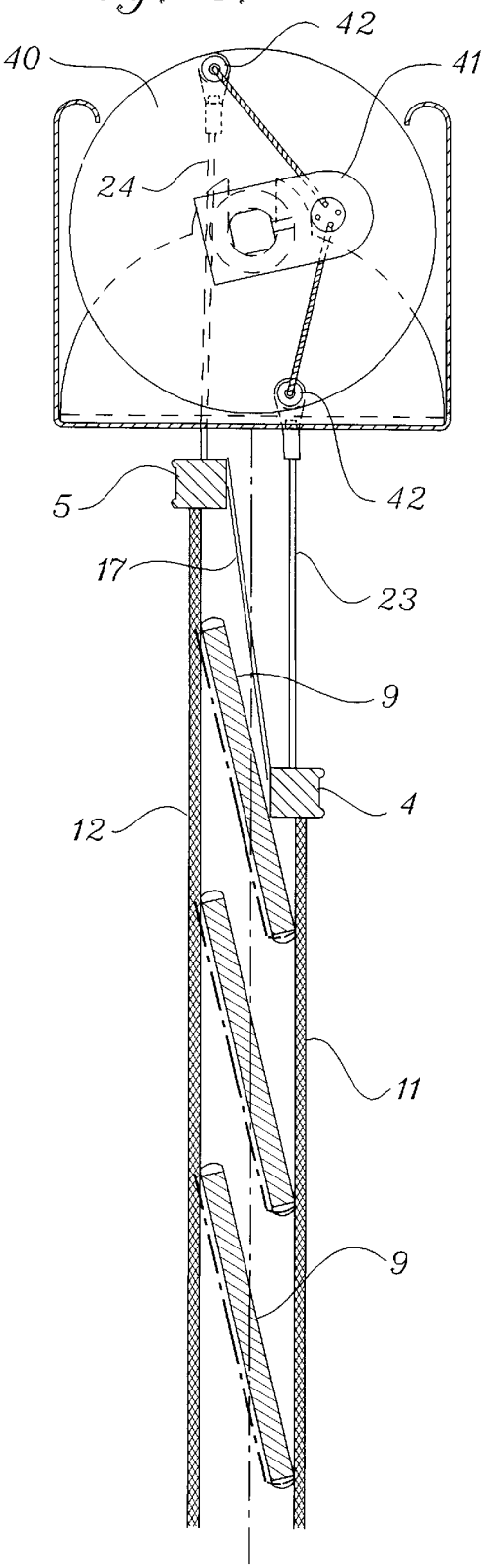
FIG. 12 is a sectional view similar to FIG. 11 showing the blind in a closed, tilted position.

The tilt mechanism can be seen in FIGS. 1, 3, 4, 11, and 12. The tilt mechanism consists of disks 40 through which preferably a pair of lift cords connected to the movingrail 21, 22 or 23, 24 pass. There is one disk for each pair of lift cords 21, 22, 23, 24. The disks 40 are mounted on a tilt rod 46 so that rotation of the tilt rod will turn the disks in unison. The tilt rod is suspended above the base of the headrail by cradles 50. A right angle drive or worm gear drive is provided at one end of tilt rod 46. The drive extends through the headrail 2 to provide a handle which is turned to open and close the blind. FIGS. 11 and 12, show the blind tilted opened and closed respectively. Rotation of the disks 40 in either direction lifts one movingrail lift cord 21 over the other 22 and pulls the cords closer together. If a two-piece movingrail is used, one rail 4 is lifted and the other 5 is lowered A one-piece movingrail would tilt as a slat tilts, with one edge being raised relative to the other. The cord ladders 10 tilt as do the lift cords, with one rail 11 being raised while the other 12 is lowered. Similar tilting as described for the movingrails can be expected in the bottomrails 7 and 8, depending on whether a two-piece or one-piece bottomrail is used. The disks can be rotated 180 degrees. The blind slats 9 will be in a nearly closed position after the disks 40 have been rotated through approximately 90 degrees. As the disks 40 are rotated the lift cords 21–24 and the rails 11 and 12 of the ladders are constantly in tension. This prevents lateral movement of the slats. By using this mechanism to tilt the lift cords 21–24, the weight of the blind is shifted along the center of gravity. The weight of the blind is not lifted or transferred, and as a result the blind stays in place parallel to the window.

A second embodiment is shown in FIGS, 6, 8, 10, 13, and 14. The front of this embodiment looks similar to the front of the first embodiment shown in FIG. 2. This embodiment consists of the same elements: a fixed headrail with mechanism for tilting the lift cords of the movingrail; a movingrail 3, bottomrail 4, and slats 9 positioned therebetween, cord ladders 10, a set of four lift cords 21–24 extending from the movingrail to the headrail, and a set of lift cords 91–94 extending from the bottomrail to the headrail. In this embodiment, I prefer to use an edge lift cord system to lift and control the bottomrail and a variation in the tilt mechanism which allows for a thinner headrail.

As in the first embodiment, the movable body of the blind consists of a movingrail 3 with two pairs of lift cords 21–24 connected to a tilt mechanism in the fixed headrail; a bottomrail 6; and a set of slats 9 positioned therebetween. Both the movingrail and bottomrail can be one-piece or two-piece if desired. For illustration purposes, the drawings show only six slats. Any number of slats, most likely more than six, will be used. The slats shown are symmetrical to a horizontal plane passing through the front and back edges of the slat. Other types of slats, such as crowned, s-shaped, or asymmetrical slats, may be used instead of the flat slats. The slats are suspended on a cord type ladder 10. A third ladder may that is not accompanied by lift cords is shown; more ladders and lift cords may be used for wider or heavier blinds. As in the first embodiment, the ladder rungs are preferably groups of two to four cords and the bottom ends of the ladders are knotted within the bottomrails 7,8 and are covered by plugs 15. If desired, cord ladders could be replaced with fabric tape ladders or sheets of flexible material. Cord 17 is provided to tie the movingrails and bottomrails 7,8 together to prevent flaring out.

Figure 6A:
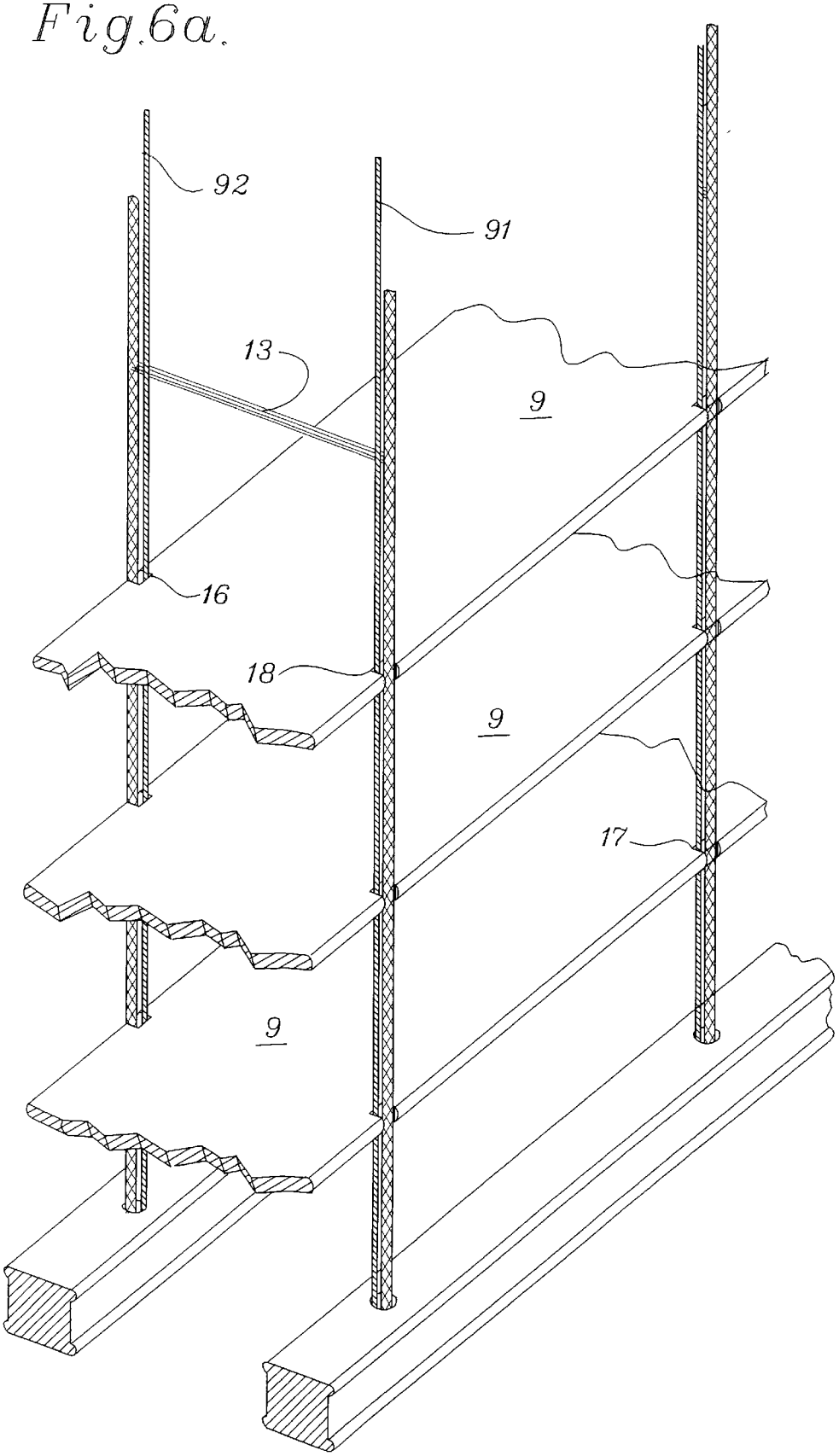
FIG. 6*a* is a perspective view of an alternate bottomrail lift cord arrangement using a two-piece bottomrail.

As can be seen in FIG. 6*a,* at least two front slots 16 are provided on the front edge of each slat 9. Corresponding rear slots 18 have been cut into the back edge of slat 9 opposite slots 16. The slots 16, 18 can be directly opposite one another as shown, or slots could be offset one to the left or right of the other. The slots are sized so that the lift cords 91, 92, 93, 94, which control the bottomrail and ends of rungs 13 can loosely fit therein. For purposes of illustration, the lift cords are shown in chain line or dotted line in some of the figures to distinguish them from ladder rails 11, 12. Cord ladders 10 are positioned evenly along the blind as necessary to support the slats, and near the ends of the blind. At least one set of the rails 11 and 12 are adjacent the lift cords. Slots 16,18 preferably have a depth so that only the lift cords 91–94 and ends of rungs 13 can completely fit therein. Thus the ladder rails 11,12 are ideally never fully within the slots.

Figure 13A:
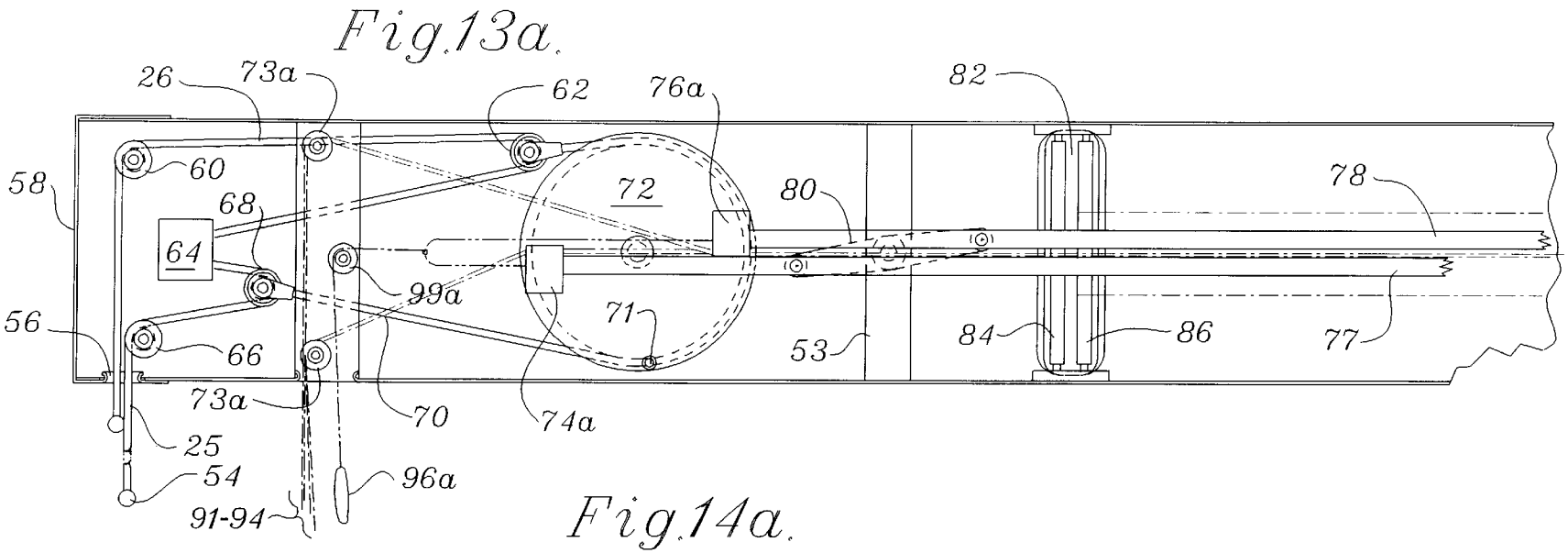
FIG. 13*a* and FIG. 13*b* are views of the headrail showing the left and right halves respectively of an alternate tilt mechanism.
Figure 14A:
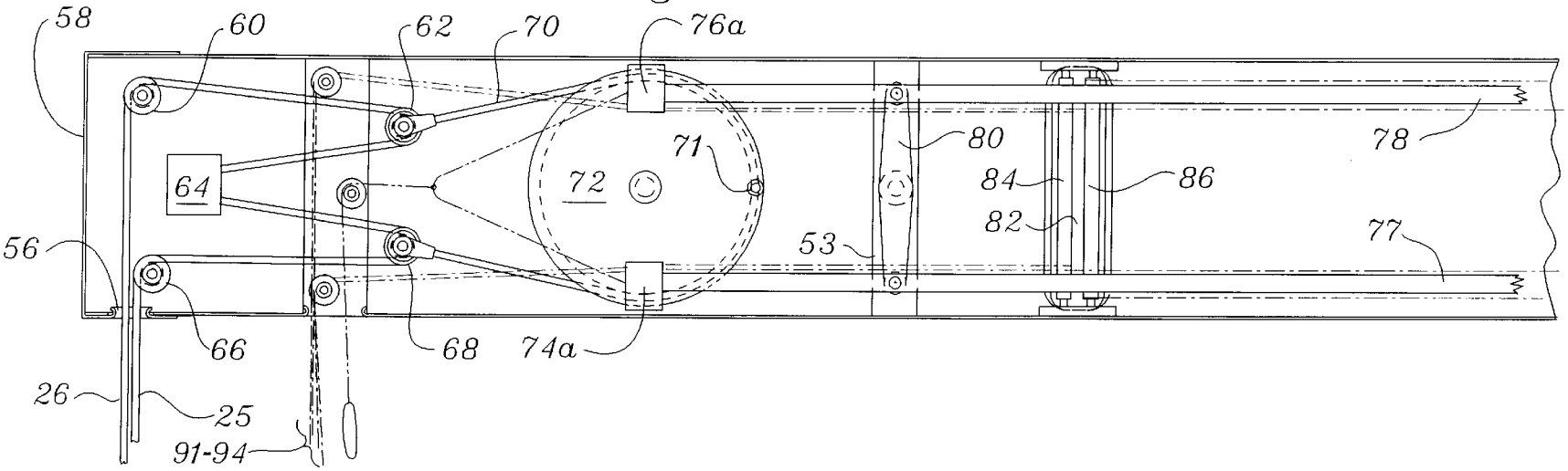
FIG. 14*a* and FIG. 14*b* are views of the headrail showing the left and right halves respectively of an alternate tilt mechanism in an open position.
Figure 13B:
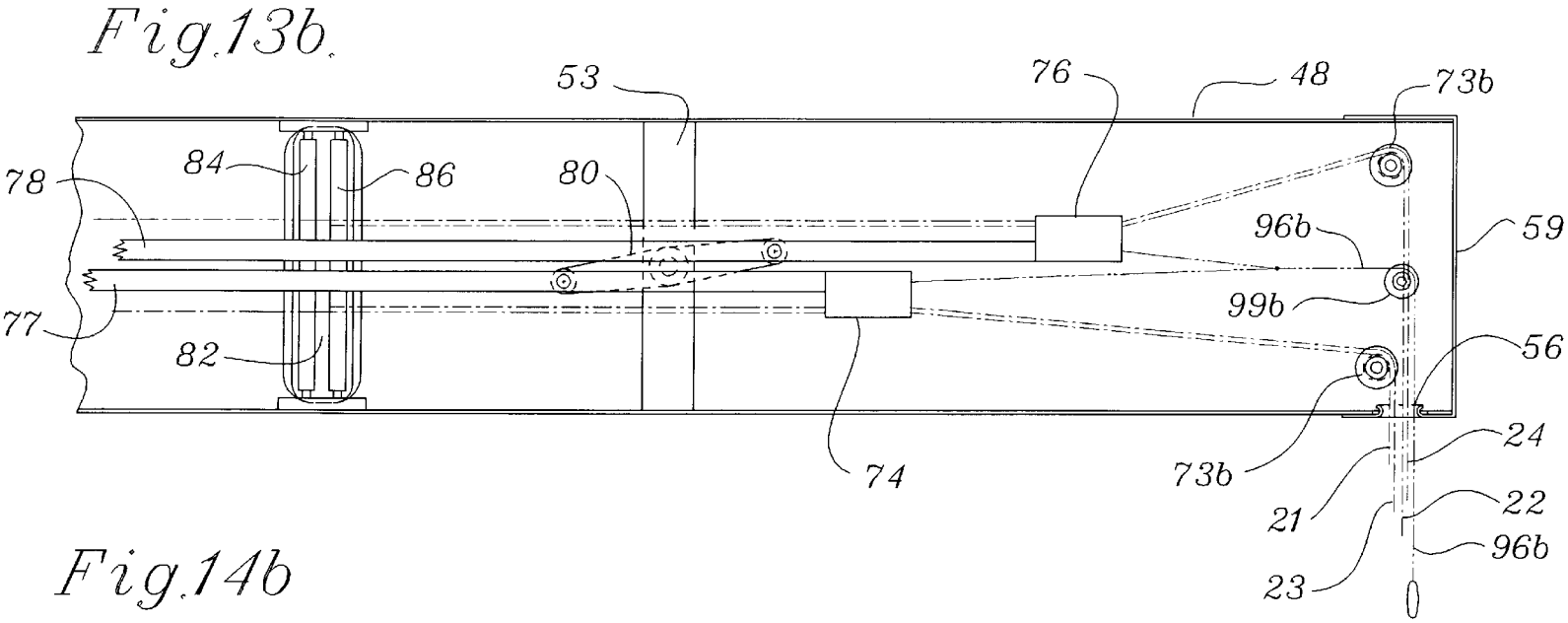
Figure 14B:
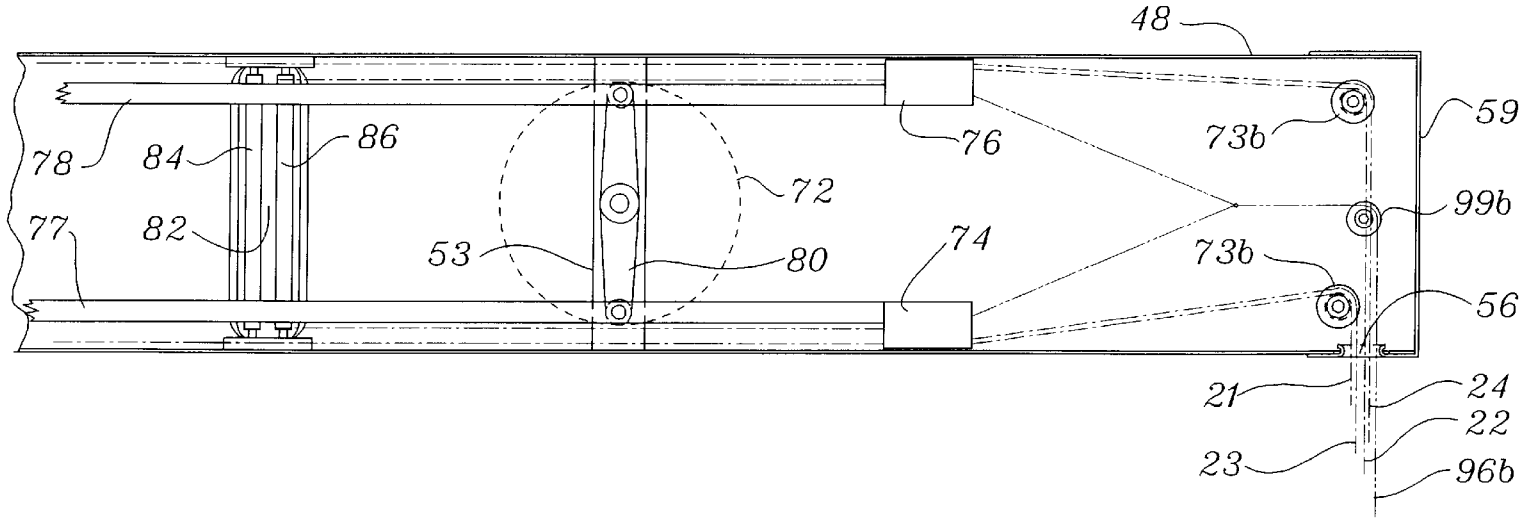

In this embodiment lift cords which control the movingrail 21–24 are routed into the headrail as shown in FIGS. 13 and 14. The cords pass into the left and right openings 82 of the headrail, over rollers 86, and into cord locks 74*b*, 76*b*. The cords extend from the cord locks over pulleys 73 and out of the headrail, in this case at the right end, as shown in FIG. 13*b* and 14*b*. If desired, the pulleys 73 may be mounted on a platform similar to what is shown in FIGS. 13*a* and 14*a* to prevent the lift cords 21–24 from becoming entangled with other cords or hardware. The distal end of the lift cords 21–24 may be tied together in a ball connector if preferred. If desired a pull cord having a tassel may also be connected to the ball connector.

Figure 8:
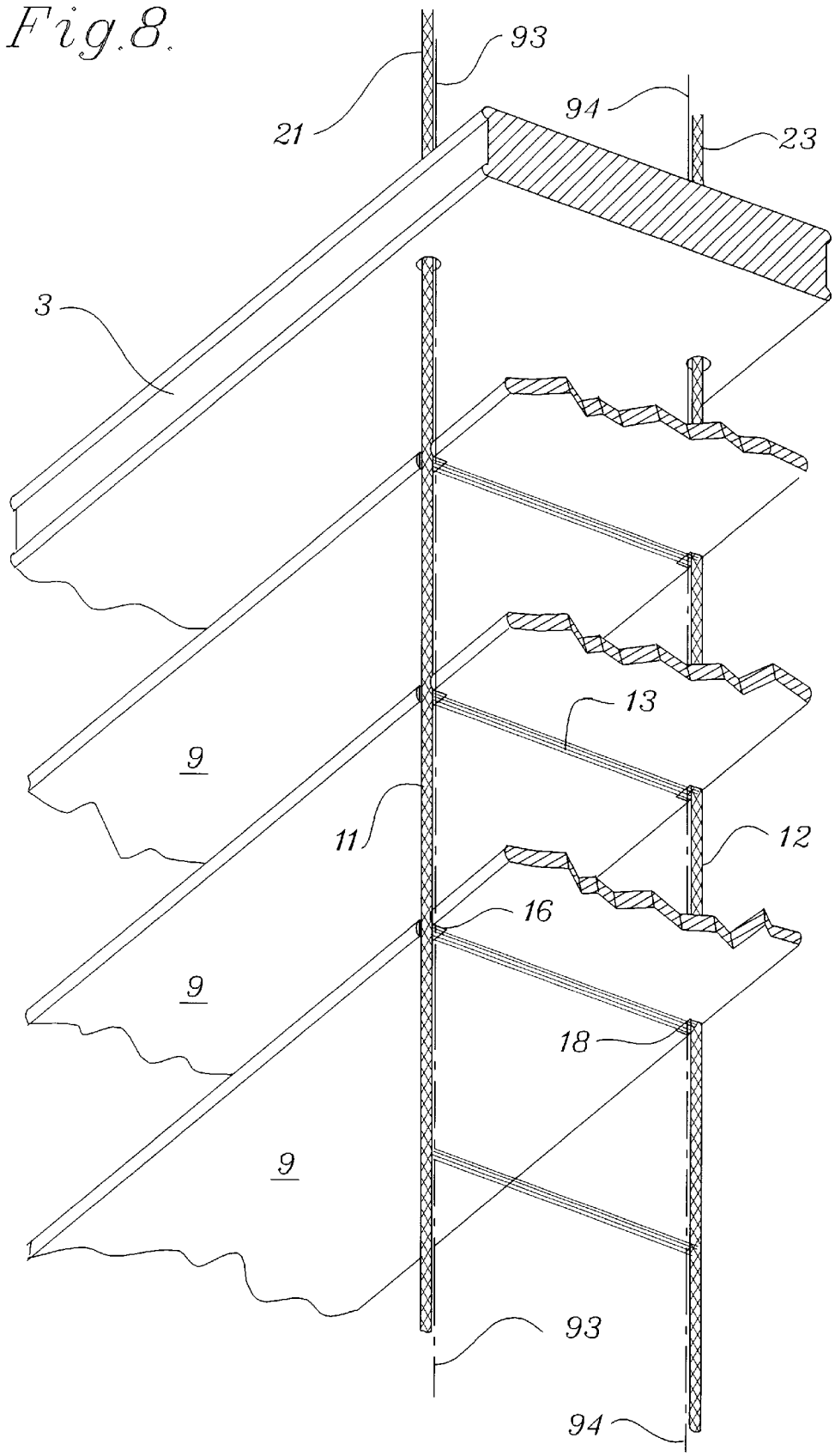
FIG. 8 is a perspective view similar to FIG. 5 showing an alternative single movingrail and an edge lift cord system used to lift and control the bottomrail.
Figure 9:
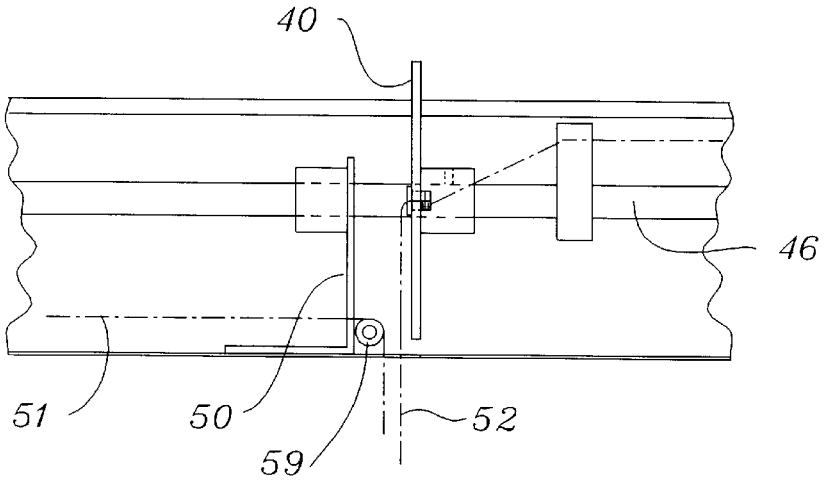
FIG. 9 is a front view of a portion of the headrail with the front panel removed to show cording arrangements and the tilt mechanism.
Figure 10:
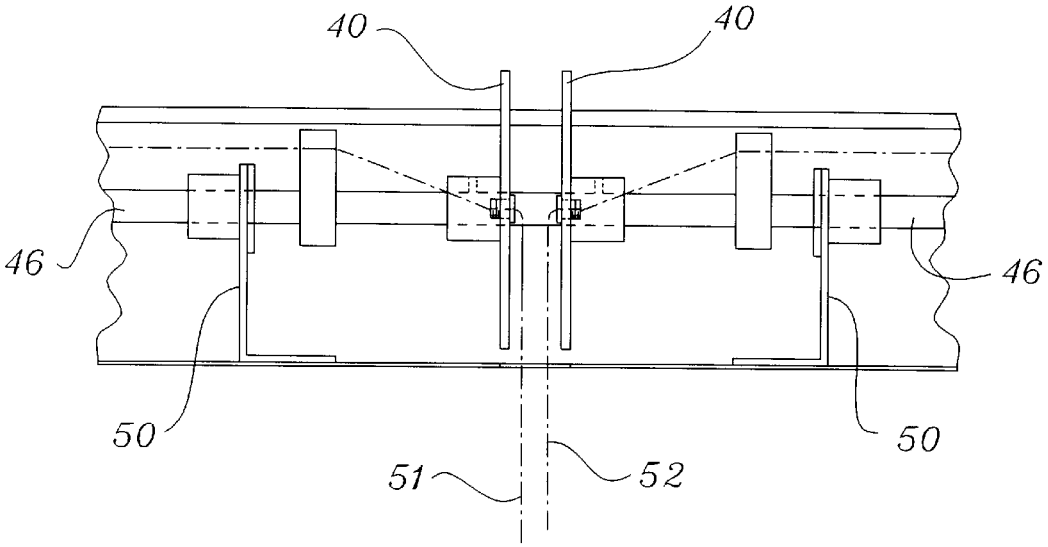
FIG. 10 is a front view of a portion of the headrail with the front panel removed to show alternate cording arrangements and the tilt mechanism.

The cords which control the bottomrail 91–94 should be positioned near either end of the blind in slots on both the front and rear edges of the slats 9. As shown in FIG. 8 and FIG. 11, lift cords 91 and 93 extend from the front bottomrail through front slots 16 in slats 9. Cords 92 and 94 extend from rear bottomrail 5 through slots 18 in rear edge of slats 9. All four lift cords 91–94 pass into the headrail at openings 82. Lift cords 91–94 pass over rollers 84 and into cord locks 74*a*, 76*a*. From the cord locks, the lift cords 91–94 pass over pulleys 73*a* which are mounted on a platform 95 above the tilt hardware. This prevents the lift cords and tilt cords from interfering with each other or from tangling. From the pulleys, the lift cords 91–94 extend out of the headrail, in this case on the left side. The distal end of the lift cords 91–94 may be tied together in a ball connector. If desired a pull cord having a tassel may also be connected to the ball connector.

Shown in FIGS. 13*a*, 14*a*, 13*b*, and 14*b* are release cords 96 which permit the use of automatically locking type cord locks. The release cords 96 are attached to the cord locks 74, 76 via a yoke 97. The release cords 96 extend over pulleys 99 and out of the headrail on opposite sides to points readily accessible to the user, where a tassel may be attached if desired. When the operator pulls release cord 96*a*, the bottomrail will be lowered as the cord locks which control lift cords 91–94 are released. Pulling release cord 96*b* will cause the movingrail to be lowered as cords 21–24 are released from cord locks. In either case, the pulling of a release cord will cause the tilt mechanism to return to the horizontal "open" position, as the force of the release cord on the yoke will cause the yoke to pull the cord locks 74, 76 to the points shown in FIG. 13*a* and 13*b*.

Figure 6B:
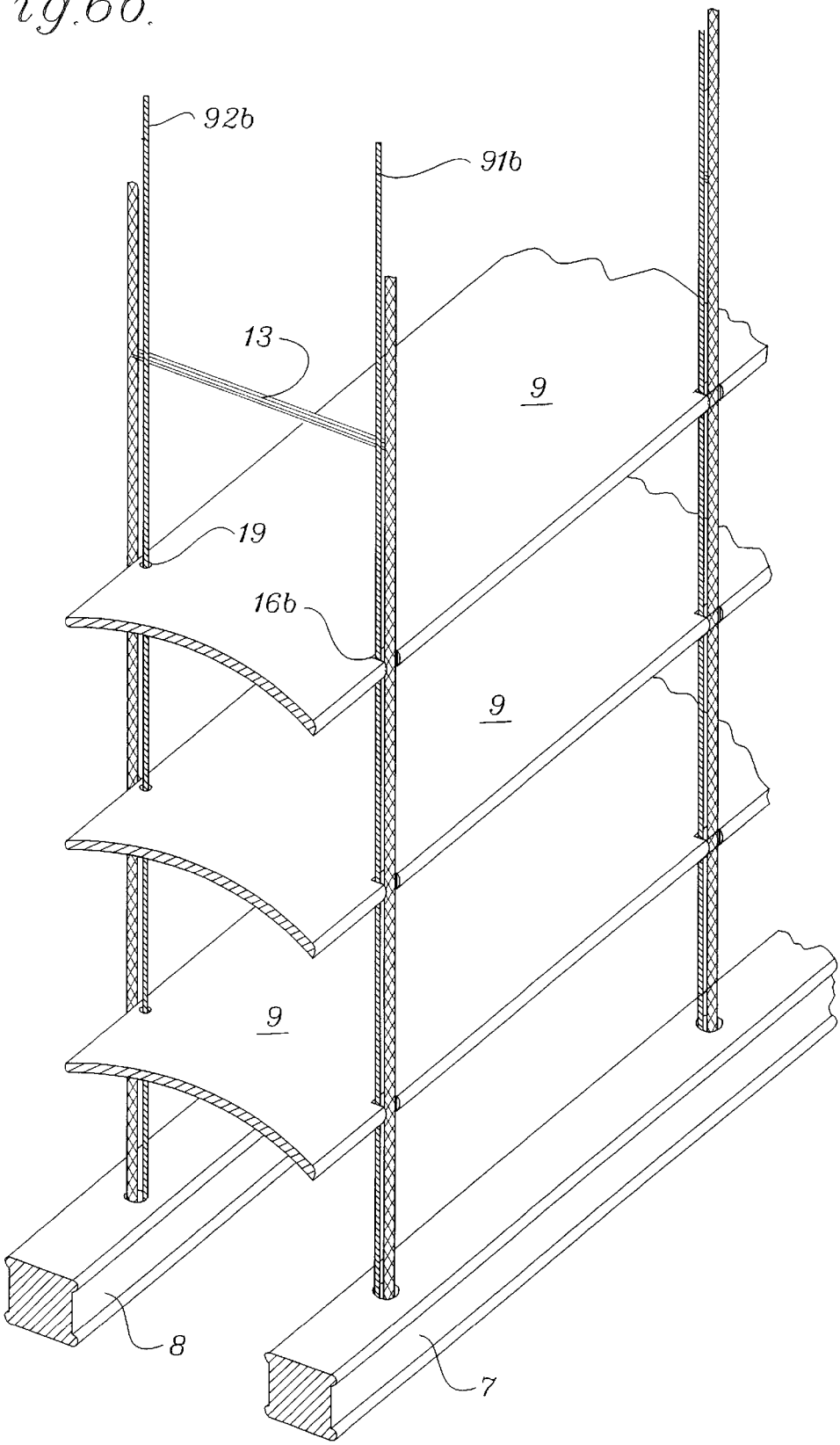
FIG. 6*b* is a perspective view similar to FIG. 6*a* showing the hidden holes lift cord option for the lift cords of the bottomrail.

As shown in FIG. 6*b*, a second arrangement can be used instead of the edge lift cords for the lift cords which control the bottomrail. In this configuration, the front lift cord 91*b* is routed from the bottomrail 7, through small slots 16*b* in the slats 9, and into the headrail as described above for the edge lift cords. The rear lift cord 92*b* is routed from the bottomrail 8, through tiny holes 19 placed proximate to the edge of the slat, and into the headrail as described for edge lift cords.

In these cord routing patterns the lift cords 91–94 are in tension at all times preventing lateral motion of the slats. The attached tassel can provide sufficient tension to hold the slats in place. A weight can be placed in the tassel or connector if needed. If the bottom rail is supported by the lift cords only, the weight of the bottomrail maintains the lift cords in tension, which also prevents lateral motion of the slats. If the bottomrail is supported by the tilt ladders, as in FIG. 1, the weight of the lift cords extending out to the headrail and the attached tassel can provide sufficient tension to hold the slats in place.

Figure 7:
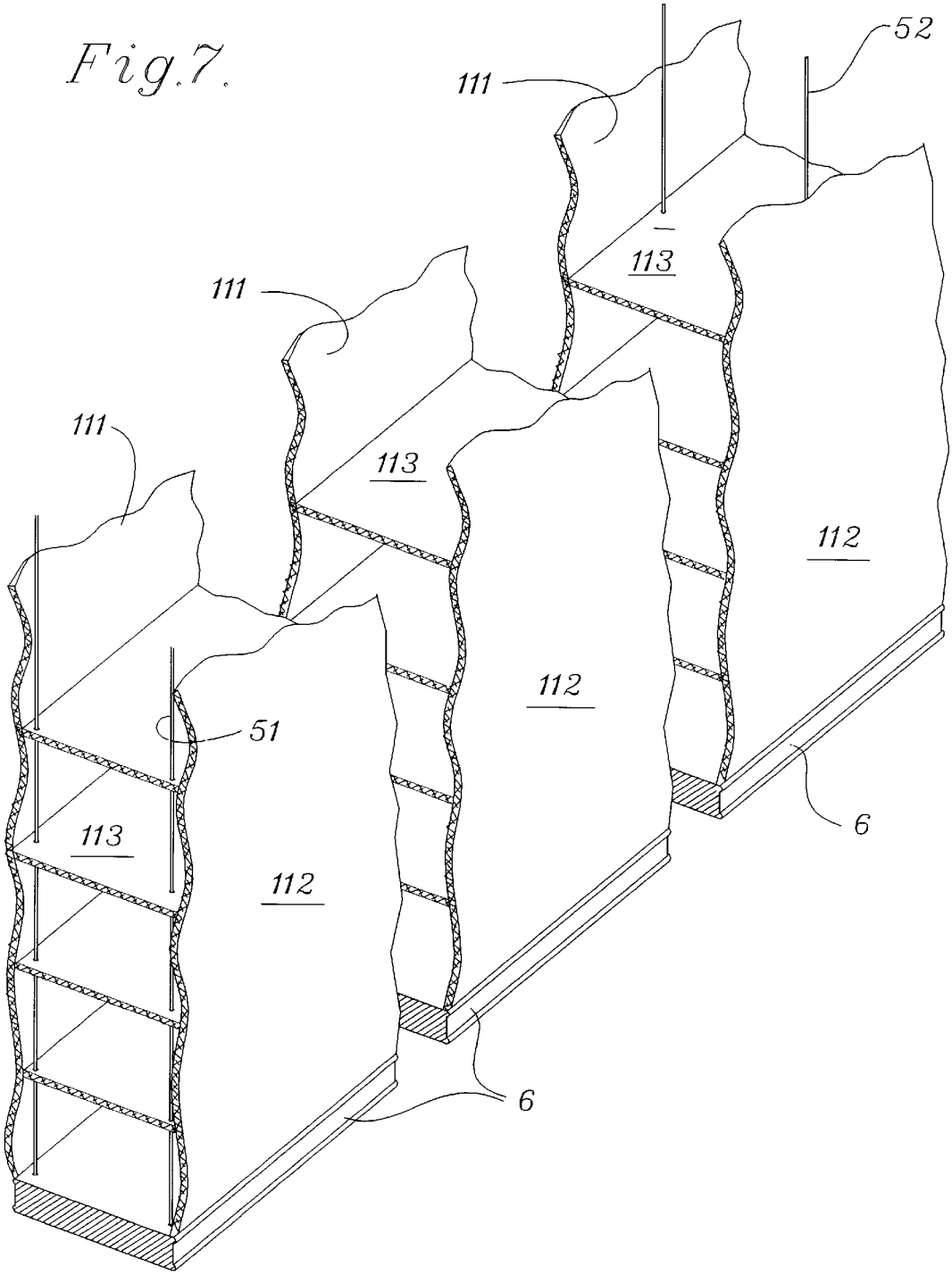
FIG. 7 is a perspective view similar to FIGS. 6*a* and 6*b* showing an alternative embodiment wherein the ladders are formed by sheets of material.

Although most embodiments of my bottom and top stacking blind use cord type ladders, this is not required. As shown in FIG. 7 the ladders could be formed by two parallel sheets of light transmissive fabric 111 and 112 connected by fabric strips 113. These strips 113 may serve as rungs and support slats (not shown) or could be made of opaque material and function as both the rungs and the slats.

A second present preferred tilt mechanism shown in FIGS. 13*a* 13*b*, 14*a*, and 14*b* tilts within a thinner, more streamlined headrail. This arrangement uses a set of parallel cross bars combined with straps or cables and cord locks to form a parallelogram that moves in tandem with the tilt ladder. In this arrangement, shown in FIGS. 13*a* 13*b*, 14*a*, and 14*b*, a pair of cords 25, 26 are attached to tassels 54. The tassels 54 may hang free or ride on a yoke or handle. The cords from the tassels pass into the front port 56 of the left end cap 58. One cord goes around the rear pulley 60 through the rear belt end pulley 62 and ties at the common tie-off 64. The other cord goes around the front pulley 66 through the front belt end pulley 68 and then ties at the common tie-off 64. The belt end pulleys 66 and 68 are at either end of the belt 70 which loops around and is connected at its center point to the tilt sheave 72. The connection point is on the medial side of the sheave and travels 180 degrees from the backside to the front side of the headrail 2 as the blind is tilted from closed in one direction to closed in the other direction. The front lift cords 21, 23 of the movingrail pass through the headrail, over rollers and into a front lift cord lock 74 which is pivotally attached to the tilt sheave 72. They would then continue around the pulley and out an end port 56 in end cap 59. Rear lift cords would follow a similar pattern through a rear lift cord lock 76. The straps 77, 78 are pivotally connected on the opposite ends of a diameter of the sheave 72 which diameter is perpendicular to the diameter that the belt 70 connection is on. The reciprocating cord locks 74, 76 are preferably fixed on top of each strap to the medial side of the connection to the sheave 72. The preferred straps 75 are each made of continuous pieces of spring steel and extend from the tilt sheave on one end of the blind to near the other end. They could be made of any material that does not stretch under the loads required to tilt the blind and may be shaped in ribbons, rods, or cables. The straps do not have to be continuous pieces, but could be segments that extend from cradle to cradle and the cradle has a segment that forms a parallelogram at each route opening. This embodiment has two straps 77, 78 that are nearly the length of the headrail and are punched at the same time in the same machine as the headrail to assure accurate alignment.

The straps 77, 78 connect to crossbars 80 that are connected pivotably at there centers to the cradles 53. The cradles 53 are placed at each ladder location and the pivoting crossbars 80 create parallelogram geometry in the vicinity of each cradle 53. For ease of understanding the drawing, cradles 53 are shown to be offset from rather than above openings 82. This parallelogram geometry synchronizes the lateral and transverse motion of the straps 77, 78 and causes them to always remain parallel and move in equal but opposite directions. The straps 77, 78 move toward the longitudinal axis of the headrail 2 when the blind is tilted and force the lift cords 21–24 and the ladder rails 11 and 12 to come together as well. The cradles 50 straddle the openings 82 in the headrail that the ladder rails 11,12 and the lift cords of the movingrail 21–24 pass through. The cradles also support rollers 86 that bend and support the lift cords.

When the operator pulls a tilt cord tassel 54 the cord 25 pulls one of the belt pulleys 62, 68 with a 2:1 mechanical advantage. The belt 70 rotates the sheave 72 which translates the straps 77, 78 and reciprocating cord locks 74, 76 laterally and transversely. This motion is duplicated at such cradle 50 because of the parallelogram geometry. The reciprocating cord locks 74, 76 move the lift cords of the movingrail 21–24 up and down and bring them closer together; the movingrail, ladders, and slats 9 tilt accordingly. If desired, the ladder rails can be attached in the headrail (FIG. 13) so that they move in tandem with the lift cords and help tilt the slats 9.

Another embodiment of the bottom and top stacking blind would have a second sheave with reciprocating cord locks on the opposite side of the headrail from the first sheave. The set of lift cords 91–94 would pass through these locks over the second lift roller and through the edge slots in the slats and attach to a single or double bottomrail.

There can be a conventional pull or pulls on the operator ends of the lift cords that run through reciprocating lift cords. However, it may be desirable to have a special cord pull with reciprocating weights because half of the cords move up and half move down when the blind is being tilted and this makes the cords loop and be less attractive when the blind is tilted. The cord pull could be a tube having two weights would be inside with the outside lift cords attached to one weight and the inside cords attached to the other weight. The weights would be configured so that they could move past each other and travel the width of the slats.

The reciprocating cord locks allow the cords to move freely at all times out of the headrail and lock automatically to oppose the weight of the shade which is whenever the cord moves into the headrail. To lower the shade the locks are released or opened by a mechanical linkage that the operator can activate. The preferred linkage is a yoke pulls the cord lock furthest from the end of the blind back towards the other lock until they are in side by side position before they are opened. The locks are configured so that they can only open when they are side by side and when the release linkage is being activated by the operator. This compensates for changes in the positions of the lift cords relative to the ladder rails that can be induced when the operator lifts or lowers the blind, since tugging on the lift cord pull will always bring the lift cords to an even or non-tilted position whether the ladders are tilted or not.

There are always two sets of lift cords in this type of blind. One set extends from the movingrail through the headrail and attaches to the tilt mechanism. This set lifts and controls the movingrail and thus the blind. The second set of lift cords, which lifts and tilts the bottomrail, can be as few as two cords, one on each side of the blind, or can be four or more cords. These cords can be single cords in a centerline lift system or pairs of cords in an edge lift system.

Since the rails 11, 12 are on the outside edges of the slats, they can fold neatly across the front of the blind when the blind is stacked in the lowered position shown in FIG. 2. The rails may be treated with a permanent pleating to provide a memory in the rails so that they will fold in the desired manner.

The cord ladders may be replaced with ladders of fabric sheets or fabric tape. The ladders are not part of the tilt mechanism, and therefore do not need to be made of cord. They will always terminate at the movingrail.

It is desirable to use cord release type cord locks for all cord locks in the blind. These cord locks hold the cords locked in place automatically unless released by the user, as opposed to the conventional cord which must first be locked by the user.

Of the two embodiments, the first described system is the simplest operation; the second can be used to provide a sleek, less space-consuming headrail, which is useful when employing thick wood slats or fabric blinds which would have a smoother appearance with a less bulky headrail. Other than this variation, both described embodiments of this invention provide the same primary advantages. First, the ability to use the movingrail lift cords to tilt the blind from a mechanism in the fixed headrail allows for most of the hardware to be placed inside the headrail. All of the controls are kept in this fixed, optimum position for simple one-hand operation.

Second, no specialized hardware is needed, because the lifting and tilting mechanisms consist of hardware common to venetian type blinds. The manufacturer can use a few preexisting pieced of hardware to create a headrail which can then be used for any type of blind: bottom and top stacking, traditional top stacking, centerline lifting, or edge lift (no-holes) lifting, or any combination of these.

Finally, since the ladders of this blind are completely independent of the tilting mechanism, and are attached at the movingrail as opposed to the headrail, the ladders could then be made of any material, in any style, the only condition being that they are sturdy enough to help support the slats. They need not be connected to the tilt mechanism, only to the movingrail or rails which tilt along with the ladders. In summary, the manufacturer can use one design of headrail to create any "look" for the blind which the customer may choose.

Although I have shown and described certain present preferred embodiments of my venetian blind it should be distinctly understood that the invention is not limited thereto but may be variously embodied within the scope of the following claims.

I claim:

1. A venetian type blind comprising:

a bottomrail;

a plurality of slats above the bottomrail, each slat having an inside edge and an outside edge and a first pair of oppositely disposed slots one slot on the outside edge and one slot on the inside edge and a second pair of oppositely disposed slots one slot on the inside edge and one slot on the outside edge, the first pair of slots being laterally spaced apart from the second pair of slots;

a movingrail above the plurality of slats a headrail above the movingrail, the bottomrail and the plurality of slats;

at least two pairs of movingrail lift cords attached to the movingrail and passing through the headrail;

a first ladder having opposite cord type rails and rungs extending therebetween, the rails positioned near the first pair of slots and connected to the bottomrail;

a first pair of lift cords adjacent to the first ladder, and connected to the bottomrail, one lift cord running through slots in the inside edge of the slats and one lift cord running in the slots on the outside edge of the slats, the first pair of lift cords passing through the movingrail and the headrail;

a second ladder having opposite cord type rails and rungs extending therebetween, the rails positioned near the second pair of slots and connected to the bottomrail;

a second pair of lift cords adjacent to the second ladder, and connected to the bottomrail, one lift cord running through slots in the inside edge of the slats and one lift cord running though the outside edge of the slats the second pair of lift cords passing through the movingrail and the headrail; and a tilt mechanism attached to the headrail to which tilt mechanism the lift cords are connected and to which tilt mechanism the pairs of movingrail lift cords are attached wherein the tilt mechanism moves the movingrail lift cords in each pair of movingrail lift cords in opposite directions and together at the tilt mechanism and moves the rails of the ladders and the lift cords in each pair of lift cords together and in opposite directions adjacent the slats when the blind is changed from an open position to a closed position.

2. The venetian blind of claim 1 wherein the first pair of lift cords are alternatively laced with the rungs of the first ladder and the second pair of lift cords are alternately laced with the rungs of the second ladder.

3. The venetian blind of claim 1 wherein at least one of the lift cords passes through at least one rung of one of the ladders.

4. The venetian type blind of claim 1 wherein the slats are symmetrical to a plane passing from the front edge to the back edge of the slats.

5. The venetian type blind of claim 1 wherein the slats are one of wood, aluminum and plastic.

6. The venetian type blind of claim 1 also comprising a tube lift attached to the headrail and to which the lift cords are connected.

7. The venetian type blind of claim 1 also comprising four pulleys within the bottomrail and positioned so that one lift cord passes over each pulley.

8. The venetian type blind of claim 1 wherein the slots have a depth substantially equal to a diameter of the lift cords.

9. The venetian type blind of claim 1 also comprising at least one weight attached to at least one lift cord.

10. The venetian type blind of claim 1 also comprising a cord lock through which the lift cords pass.

11. The venetian type blind of claim 10 wherein the cord lock is always engaged unless the lift cords are being operated.

12. The venetian type blind of claim 1 wherein the lift cords have a diameter smaller than a diameter of the rails of the first and second ladders.

13. A venetian type blind comprised of:

two spaced apart parallel bottomrails;

a plurality of slats above the bottomrails, each slat having an inside edge and an outside edge and a first pair of oppositely disposed slots one slot on the outside edge and a second slot on the inside edge and a second pair of oppositely disposed slots one slot on the outside edge and a second slot on the inside edge, the first pair of slots being laterally spaced apart from the second pair of slots;

a movingrail above the plurality of slats;

a headrail above the movingrail, the bottomrail and the plurality of slats at least two pairs of movingrail lift cords attached to the movingrail and passing through the headrail;

a first ladder having opposite cord type rails and rungs extending therebetween, the rails positioned near the first pair of slots and connected to the bottomrails;

a first pair of lift cords adjacent to the first ladder, and connected to the bottomrails, one lift cord running through slots in the inside edge of the slats and attached to one bottomrail and a second lift cord running in the slots on the outside edge of the slats and attached to the other bottomrail the first pair of lift cords passing through the movingrail and the headrail;

a second ladder having opposite cord type rails and rungs extending therebetween, the rails positioned near the second pair of slots and connected to the bottomrails;

a second pair of lift cords adjacent to the second ladder, and connected to the bottomrail, one lift cord running through slots in the inside edge of the slats and attached to one bottomrail and a second lift cord running though the outside edge of the slats and attached to the other bottomrail the second pair of lift cords passing through the movingrail and the headrail; and a tilt mechanism attached to the headrail to which tilt mechanism the lift cords are connected and to which tilt mechanism the pairs of movingrail lift cords are attached wherein the tilt mechanism moves the movingrail lift cords in each pair of movingrail lift cords in opposite directions and together at the tilt mechanism and moves the rails of the ladders and the lift cords in each pair of lift cords together and in opposite directions adjacent the slats when the blind is changed from an open position to a closed position.

14. A venetian type blind comprised of:

a bottomrail;

a plurality of slats above the bottomrail, each slat having an inside edge and an outside edge and a first pair of oppositely disposed slots one slot on the outside edge and a second slot on the inside edge and a second pair of oppositely disposed slots one slot on the outside edge and a second slot on the inside edge, the first pair of slots being laterally spaced apart from the second pair of slots;

a movingrail above the plurality of slats;

a headrail above the movingrail, the bottomrail and the plurality of slats at least two pairs of movingrail lift cords attached to the movingrail and passing through the headrail;

a first ladder having opposite cord type rails and rungs extending therebetween, the rails positioned near the first pair of slots and connected to the bottomrail;

a first pair of lift cords adjacent to the first ladder, and connected to the bottomrail, one lift cord running through slots in the inside edge of the slats and one lift cord running in the slots on the outside edge of the slats the first pair of lift cords passing through the movingrail and the headrail;

a second ladder having opposite cord type rails and rungs extending therebetween, the rails positioned near the second pair of slots and connected to the bottomrail;

a second pair of lift cords adjacent to the second ladder, and connected to the bottomrail, one lift cord running through slots in the inside edge of the slats and a second lift cord running though the outside edge of the slats the second pair of lift cords passing through the movingrail and the headrail;

a tilt mechanism attached to the headrail, the tilt mechanism comprised of:

a first disk to which one pair of movingrail lift cords are attached;

a second disk to which a second pair of movingrail lift cords are attached;

an axle attached between the first disk and the second disk; and means for rotating the axle and attached disks.

15. The venetian type blind of claim 14 wherein at least one of the lift cords passes through at least one of the first disk and the second disk.

16. The venetian type blind of claim 14 wherein the means for rotating the axle and attached disks is one of a right angle drive and a worm drive.

17. A venetian type blind comprising:

a bottomrail;

a plurality of slats above the bottomrail, each slat having an inside edge and an outside edge and a first pair of oppositely disposed slots one slot on the outside edge and one slot on the inside edge and a second pair of oppositely disposed slots one slot on the inside edge and one slot on the outside edge, the first pair of slots being laterally spaced apart from the second pair of slots;

an inside movingrail and an outside movingrail, the two movingrails spaced apart, parallel to one another and above the plurality of slats a headrail above the movingrails, the bottomrail and the plurality of slats;

at least two inside movingrail lift cords attached to the inside movingrail and passing through the headrail;

at least two outside movingrail lift cords attached to the outside movingrail and passing through the headrail;

a first ladder having opposite cord type rails and rungs extending therebetween, the rails positioned near the first pair of slots and connected to the bottomrail;

a first pair of lift cords adjacent to the first ladder, and connected to the bottomrail, one lift cord running through slots in the inside edge of the slats, the inside movingrail and the headrail, one lift cord running in the slots on the outside edge of the slats, the outside movingrail and the headrail;

a second ladder having opposite cord type rails and rungs extending therebetween, the rails positioned near the second pair of slots and connected to the bottomrail;

a second pair of lift cords adjacent to the second ladder, and connected to the bottomrail, one lift cord running through slots in the inside edge of the slats, the inside movingrail and the headrail, one lift cord running in the slots on the outside edge of the slats, the outside movingrail and the headrail; and a tilt mechanism attached to the headrail to which tilt mechanism the lift cords are connected and to which tilt mechanism the movingrail lift cords are attached wherein the tilt mechanism moves the inside movingrail lift cords and the outside movingrail lift cords and the lift cords in each pair of lift cords together and in opposite directions at the tilt mechanism and moves the rails of the ladders and the lift cords in each pair of lift cords together and in opposite directions adjacent the slats when the blind is changed from an open position to a closed position.

18. A venetian type blind comprising:

a bottomrail;

a plurality of slats above the bottomrail, each slat having an inside edge and an outside;

a movingrail above the plurality of slats which does not contain a tilt mechanism;

a headrail above the movingrail, the bottomrail and the plurality of slats;

at least two movingrail lift cords attached to the movingrail and passing through the headrail;

at least two ladders having opposite rails and rungs extending therebetween, the plurality of slats being supported on the rails;

at least two lift cords connected to the bottomrail and passing through the movingrail and the headrail; and a tilt mechanism attached to the headrail to which tilt mechanism the lift cords and the movingrail lift cords are connected wherein the tilt mechanism moves the movingrail lift cords to tilt the movingrail so that the rails of the ladders move together and in opposite directions adjacent the slats and the plurality of slats pivot along lines in a vertical centerline plane through the blind when the blind is changed from an open position to a closed position.

19. The venetian type bliind of claim 18 wherein the opposite rails of the ladders are formed by a first sheet of fabric adjacent the inside edge of the slats and a second sheet of fabric adjacent the outside edge of the slats.

20. A venetian type blind comprising:

a bottomrail;

a plurality of slats above the bottomrail, each slat having an inside edge and an outside;

a movingrail above the plurality of slats;

a headrail above the movingrail, the bottomrail and the plurality of slats;

at least two movingrail lift cords attached to the movingrail and passing through the headrail;

at least two ladders having opposite rails and rungs extending therebetween, the plurality of slats being supported on the rails;

at least two lift cords connected to the bottomrail and passing through the movingrail and the headrail;

an axle driven cord collection system to which the movingrail lift cords are attached; and a tilt mechanism attached to the headrail to which tilt mechanism the movingrail lift cords are attached.

21. The venetian type blind of claim 20 wherein the axle driven cord collection system is comprised of a tube lift.

* * * * *